United States Patent [19]

Harkus

[11] Patent Number: 4,934,594

[45] Date of Patent: Jun. 19, 1990

[54] FASTENING RAILWAY RAILS

[75] Inventor: Lance Harkus, New South Wales, Australia

[73] Assignee: Pandrol Limited, London, United Kingdom

[21] Appl. No.: 260,177

[22] Filed: Oct. 19, 1988

[30] Foreign Application Priority Data

Oct. 19, 1987 [AU] Australia ..... 79914/87
Oct. 13, 1988 [GB] United Kingdom ..... 8824065

[51] Int. Cl.[5] ..... E01B 9/30

[52] U.S. Cl. ..... 238/310; 238/315; 238/349; 238/351

[58] Field of Search ..... 238/310, 299, 315, 338, 238/343, 349, 351, 344, 345, 352, 353, 283, 377, 378, 265; 403/273, 277, 280, 372, 365, 375, 225, 357, 356; 384/296, 295, 906

[56] References Cited

U.S. PATENT DOCUMENTS

| | | | |
|---|---|---|---|
| 2,046,817 | 7/1936 | Geil et al. | 403/225 |
| 3,134,611 | 5/1964 | Iversen | 403/225 |
| 3,315,537 | 4/1967 | Keller | 403/225 |
| 3,326,466 | 6/1967 | Sanson | 238/349 |
| 3,957,201 | 5/1976 | Johnson et al. | 238/349 |
| 4,316,643 | 2/1982 | Burk et al. | 403/225 |
| 4,466,569 | 8/1984 | Taylor | 238/349 |
| 4,625,912 | 12/1986 | Fee | 238/349 |
| 4,706,367 | 11/1987 | Garringer | 403/365 |
| 4,757,945 | 7/1988 | Leeves | 238/283 |

FOREIGN PATENT DOCUMENTS

| | | | |
|---|---|---|---|
| 556966 | 6/1984 | Australia . | |
| 897056 | 10/1983 | Belgium . | |
| 0050048 | 4/1982 | European Pat. Off. . | |
| 968659 | 9/1964 | United Kingdom . | |
| 1044884 | 10/1966 | United Kingdom | 238/349 |
| 1059190 | 2/1967 | United Kingdom . | |
| 1099201 | 1/1968 | United Kingdom . | |
| 1557315 | 12/1979 | United Kingdom . | |
| 2087460 | 5/1982 | United Kingdom | 238/343 |
| 2105389 | 3/1983 | United Kingdom . | |

OTHER PUBLICATIONS

A prior anchoring device illustrated by photographs denoted FIG. A, FIG. B and FIG. C and made in the U.S. prior to the present invention by a company not related to the inventor or his assignee.

*Primary Examiner*—Andres Kashnikow
*Assistant Examiner*—Mark T. Le
*Attorney, Agent, or Firm*—Norbert P. Holler

[57] ABSTRACT

An anchoring device (1) anchors a clip (60) to a foundation (50) for a railway rail (66). It has a head part (2) formed with a horizontal passageway (4) which is wider than it is high. In an upstanding wall section (5) there is a recess (6) and this receives a projection (52) on an electrically insulating bushing (51) which fits in the head part (2). The bushing has a passageway (53) through it and this receives two legs (61) and (62) of an e-shaped clip, the cross-section of the passageway having the shape of an athletics race track. The device (1) has a tail part (3) with projections (22 and 23) above which the tail part is of cruciform cross-section, with vanes (26 and 28).

14 Claims, 4 Drawing Sheets

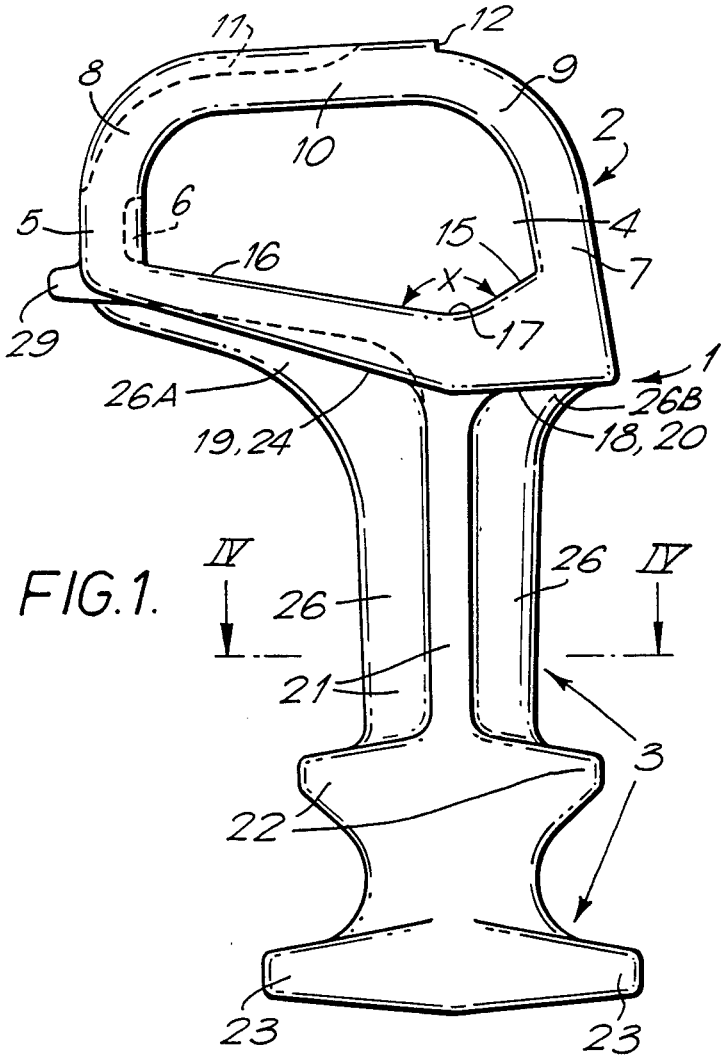
FIG.1.
FIG.4.
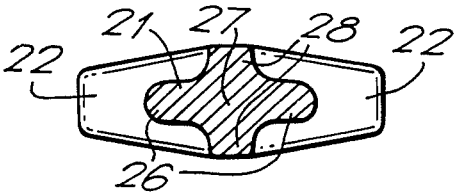

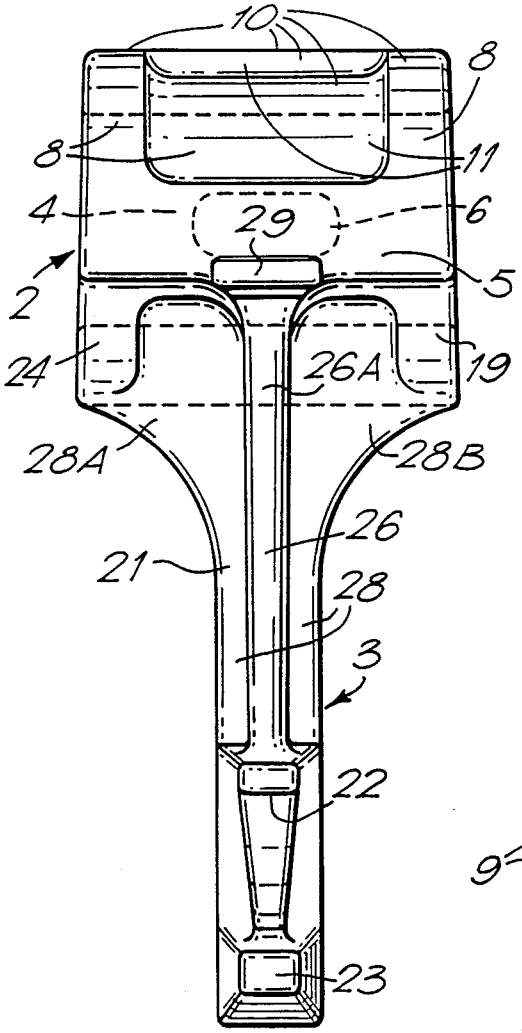
FIG. 2.
FIG. 3.
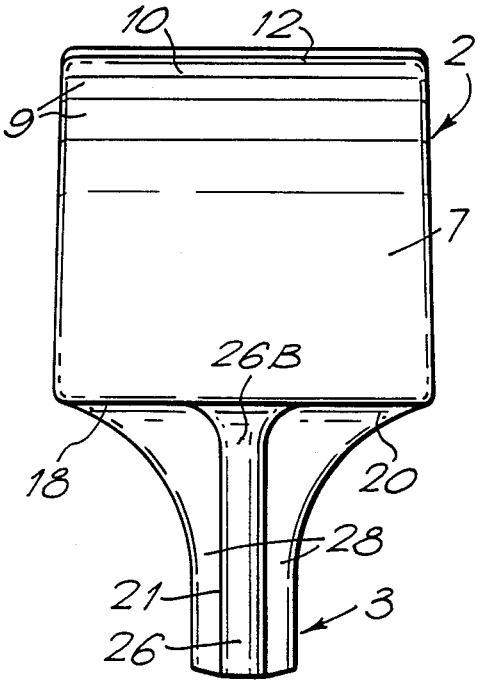

FASTENING RAILWAY RAILS

This invention relates to the art of fastening railway rails to a road bed, and in particular to an anchoring device for holding a railway rail down on a rail foundation such as a tie or sleeper.

BACKGROUND OF THE INVENTION

It is known to provide an anchoring device which is suitable for use in anchoring a railway rail-fastening clip to a fail foundation, the device including (when in the orientation in which it is used) a part which is to lie above the foundation and is formed with an upper wall section and two opposite upstanding wall sections joined to opposite extremities of the upper wall section, these wall sections partially defining a substantially horizontal passageway.

Such anchoring devices, made by casting metal, are disclosed in Belgian Patent No. 897,056 and U.S. Pat. No. 3,326,466, for example, with the latter also disclosing devices of this type made by bending sheet metal. In the anchoring devices shown in the drawings in these patents, there is no electrically insulating material in the passageways, which in each case receive a single limb of a rail clip made by bending a metal bar of circular cross-section. Thus, the clip makes direct contact with the anchoring device. It is, however, stated in the said U.S. patent that a sleeve of plastics material such as nylon could be fitted into the passageway and the limb of the clip could be driven into the sleeve. The purpose of the sleeve is not stated, nor is its shape, but a person skilled in the art would assume that it is of circular cross-section and intended for use as an anti-wear liner.

BRIEF DESCRIPTION OF THE INVENTION

According to the present invention, the anchoring device hereby contemplated is characterized in that one of the above-mentioned upstanding wall sections has, on one side of the passageway, an opening extending outwardly from the passageway and extending over only a portion of the length of the passageway, not including either of the ends of the passageway, which opening can receive a locating projection on the outside of an electrically insulating bushing when the latter is inserted in the passageway, in order to locate the bushing. The advantage of this construction is that when the locating projection is present and projects into said opening, the bushing is less likely to move along the passageway when part of the clip is driven into it.

BRIEF DESCRIPTION OF THE DRAWINGS

In the accompanying drawings, which show examples in accordance with the invention:

FIG. 1 shows a front elevation of a first anchoring device,

FIG. 2 shows in elevation the left side of the anchoring device,

FIG. 3 shows in elevation the upper part of the right side of the device,

FIG. 4 shows a cross-section of the lower part of the device, taken as indicated by the arrows IV in FIG. 1.

DETAILED DESCRIPTION OF THE INVENTION

Figure 5:
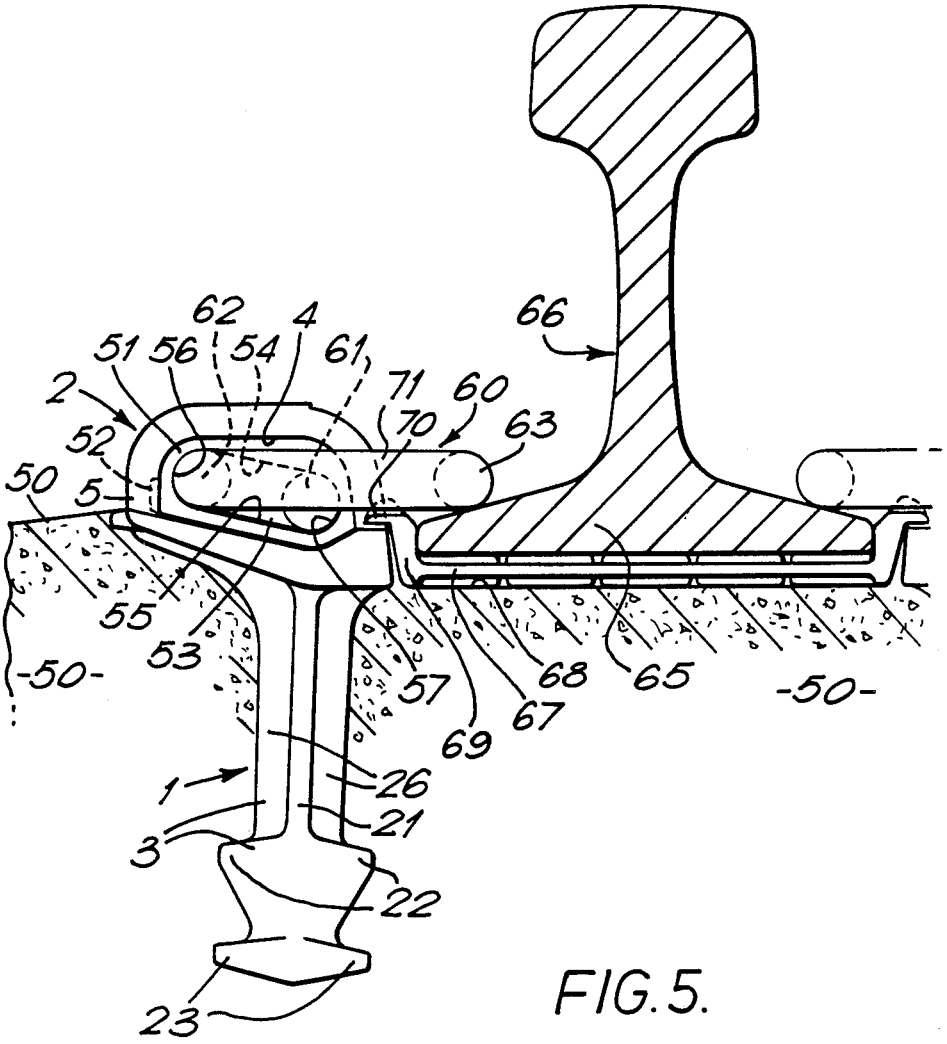
FIG. 5 shows an elevation of an assembly including the anchoring device.

FIGS. 1 to 4 show an anchoring device 1 which has been made by casting malleable steel, the device having a head part 2 and a tail part 3. The head part is formed with a passageway 4 through it, the maximum width of the passageway, measured horizontally in FIG. 1 (which shows the device approximately in the orientation which pertains when the device is in use), which is at least 50% greater than its maximum height, measured vertically in FIG. 1. The passageway 4 is bounded on both sides by upstanding wall sections, i.e., on its left side by a nearly vertical wall section 5, in which there is formed a recess 6 which extends outwardly from the passageway 4, and on its right side by an inclined but nearly vertical wall section 7, the wall sections 5 and 7 being joined by curved wall sections 8 and 9 to an upper wall section 10 which is substantially horizontal but is slightly inclined to the horizontal. Due to the presence of the wall sections 8 and 9, the corners where the wall sections 5 and 10 and 7 and 10 meet are rounded. A recess 11 is formed in the upper wall section 10 and in the curved wall section 8 in order to save material and there is a step having a vertical face 12 at the junction of the wall sections 9 and 10.

The recess 6 constitutes, on one side of the passageway, an opening extending outwardly from the passageway and extending over only a portion of the length of the passageway, not including either of the ends of the passageway, which opening can receive a locating projection on the outside of an electrically insulating bushing when the latter is inserted in the passageway, in order to locate the bushing.

At its lower side, the passageway 4 is bounded by two flat surfaces 15 and 16, which are inclined to one another by an angle X which is much greater than 90° and much less than 180°, for example about 135°. The surfaces 15 and 16 are joined by a curved surface 17 and externally the head part has two downwardly-facing flat surfaces 18 and 19 at the front of the device and similar surfaces 20 and 24 at the rear of the device.

The tail part 3 of the device consists of a single vertical rod 21 from which project, near its bottom, two projections 22 which extend from the rod in opposite directions at right angles to the length of the passageway, which is from left to right in FIGS. 2 and 3 and vertical in FIG. 4. Below the projections 22, at the extreme lower end of the rod 21, there project from the rod 21 two projections 23 which extend from the rod in opposite directions, again perpendicular to the length of the passageway 4. Over substantially the entire distance from the tops of the projections 22 to the bottom of the head part 2, the rod 21 is of cruciform cross-section, as shown in FIG. 4, so that it has two vanes 26 extending in opposite directions from a central zone 27 and two shorter vanes 28 also extending in opposite directions from the central zone 27. The vanes 26 extend along the underside of the head part 1, as shown at 26A and 26B, and likewise the vanes 28 extend across the underside of the head part 1 as shown at 28A and 28B.

The tail part 3 of the device is intended to be incorporated in a concrete railway sleeper. Four of the anchoring devices are suitably supported in a mould and each of them is prevented from rotating by suitable members engaging the vertical face 12 and a projection 29 extending from the wall 5. The concrete envelops and grips the parts 21 to 26, 26A, 26B, 28, 28A and 28B and engages the surfaces 18 to 20 and 24. When the concrete has set and the four anchoring devices 1 are used to anchor railway rail-fastening clips, the projections 22 and 23 resist forces tending to pull the anchoring devices vertically out of the concrete and the vanes 26 and 28 resist forces tending to rotate the anchoring devices about vertical axes.

FIG. 5 shows a concrete railway sleeper 50, an anchoring device 1, according to FIGS. 2 to 4, which has its tail part embedded in the sleeper with the passageway 4 above the concrete and a bushing 51 of electrically insulating material which is inserted in the passageway 4 and fits it snugly, with the two ends of the bushing projecting beyond the front and the rear of the device 1, i.e. beyond its left-hand and right-hand extremities, considering FIG. 2. The bushing is formed with a projection 52 at its left-hand side which projects into the recess 6 in the wall 5 of the device 1 to locate the bushing, i.e. to fix the bushing to the anchoring device 1. The bushing also has a passageway 53 extending through it, the shape of cross-section of the passageway being substantially the shape of a conventional athletics race track, with two parallel sides 54 and 55, inclined by a small angle of the horizontal and two semi-circular ends 56 and 57. A substantially e-shaped clip 60, made by bending a steel rod of circular cross-section, has the centre arm 61 and the upper arm 62 of the e driven into the passageway 53, which they fit nicely, and the lower arm 63 of the e bearing downwardly on the flange 65 of a railway rail 66. The flange 65 lies on a resilient pad 67 in a recess 68 in the sleeper, the pad having upstanding side portions 69 at the tops of which there are sideways-projecting portions 70 formed with recesses, one of which receives a part 71 of the clip which joins the arms 62 and 63 to each other.

Figure 6:
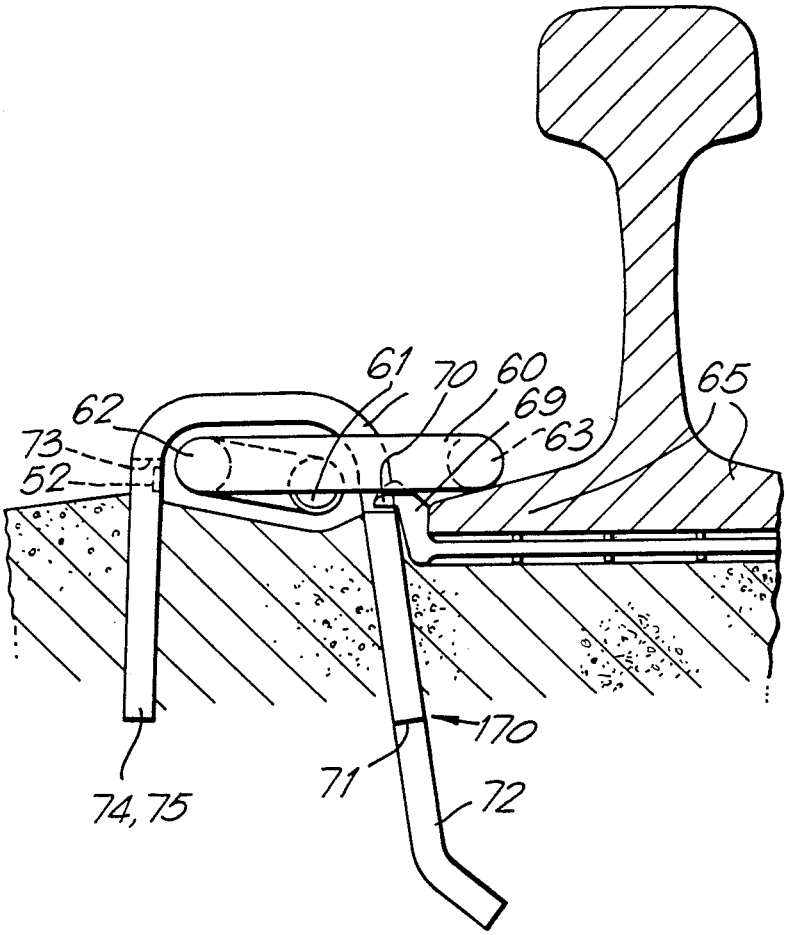
FIG. 6 shows a corresponding view of an assembly using a different anchoring device.

FIG. 6 shows a somewhat similar assembly, corresponding parts of which are similarly numbered, but here the anchoring device 170 is made by bending a strip of sheet steel which has a constant width and is imperforate from the top 71 of a tongue 72, of reduced width, to the tops 73 of two arms 74 and 75, of which arm 75 is behind arm 74 and spaced from it so that an opening is formed into which the projection 52 of the bushing extends. The opening extends outwardly from the passageway and extends over only a portion of its length, not including either of its ends. The passageway is defined partly by an upper wall section and two upstanding wall sections and again the corners are rounded. In this example the bushing must be assembled with the clip-anchoring device 170 before the latter is placed in the mould which is used to make the concrete railway sleeper; this is not necessary in the case of the assembly shown in FIG. 5.

The principle of having a bushing with a passageway 53 through it and a locating projection 52 on it, substantially as shown in the drawings, the bushing fitting into a clip-anchoring device having an opening into which the locating projection extends, can also be applied in the case where the rail rests on a steel railway sleeper to the top of which the anchoring device is welded or otherwise fixed; in such a case there will be no tail part or only a much shorter tail part than is shown in the drawings.

In all cases the bushings can be secured to the clip-anchoring device by two or more than two locating projections projecting into openings in the clip-anchoring device and/or by at least one locating projection on the clip-anchoring device projecting into an opening or openings in the bushing. In addition to or instead of one or more projections projecting into one or more openings, an adhesive can be used to fasten the bushing to the clip-anchoring device.

I claim:

1. An anchoring device which is suitable for use in anchoring a railway rail-fastening clip to a rail foundation, the device including, when in the orientation in which it is used, a part which is to lie above the foundation and is formed with an upper wall section and two opposite upstanding wall sections joined to opposite extremities of the upper wall section, these wall sections partially defining a substantially horizontal passageway, one of the upstanding wall sections having, on one side of the passageway, an opening extending outwardly from the passageway and extending over only a portion of the length of the passageway, not including either of the ends of the passageway, said opening being provided and adapted for receiving a locating projection on the outside of an electrically insulating bushing when the latter is inserted in the passageway, in order to locate the bushing.

2. An anchoring device according to claim 1 in which said part which is to lie above the foundation is a head part of a body which also has a tail part which is to be embedded in a concrete rail foundation.

3. A device according to claim 2 in which the tail part comprises a single vertical rod below the head part and a projection, for resisting forces tending to pull the anchoring device vertically out of the concrete, projecting laterally from the rod.

4. An anchoring device according to claim 3 having two projections extending sideways from the rod in opposite directions at right-angles to the length of the passageway.

5. A device according to claim 4 having, below said two projections, two more projections extending sideways from the rod in opposite directions at right-angles to the length of the passageway.

6. An anchoring device according to claim 1 in which said passageway has a maximum width which, measured horizontally, is at least 50% greater than the maximum height, measured vertically.

7. A device according to claim 1 in which at its lower side the passageway is bounded by two substantially flat surfaces of the device inclined to one another by an angle which is much greater than 90°.

8. A combination of a device according to claim 1 and a bushing of electrically insulating material inserted in the passageway, the bushing having a locating projection at one side which projects into said opening.

9. An anchoring device according to claim 1 in which, when it is in said orientation, said upper wall section is substantially horizontal and said upstanding wall sections are at least nearly vertical, the corners where the wall sections meet being rounded, in order to accommodate an electrically insulating bushing having substantially that shape on its upper side.

10. An anchoring device according to claim 1 which has been made by a casting operation, said opening being a recess which does not reach the exterior of the anchoring device.

11. An anchoring device according to claim 1 which has been made from sheet metal and comprises two legs extending downwardly from opposite ones of said upstanding wall sections, one of the legs being bifurcated and thus defining two arms spaced by a gap, the upper part of the gap between the two arms constituting said opening for receiving said locating projection, there being no part of the anchoring device directly vertically below the passageway and partially defining it.

12. A device according to claim 1 in which the maximum width of said passageway, measured horizontally, is at least 50% greater than the maximum height, measured vertically.

13. An assembly comprising a metallic clip-anchoring device and an electrically insulating bushing attached to it, said bushing including with a projection which extends into an opening in the clip-anchoring device, the bushing having a passageway through it, the cross-section of which has substantially the shape of an athletics race track, with two substantially straight and parallel sides and two substantially semi-circular ends.

14. An assembly comprising a metallic clip-anchoring device and an electrically insulating bushing attached to it said bushing including a projection which extends into an opening in the clip-anchoring device, the bushing having a passageway through it, the cross-section of said passageway has substantially the shape of an athletics race track, with two substantially straight and parallel sides and two substantially semi-circular ends, said bushing further having two downwardly-facing surfaces, for engagement with a concrete foundation for a railway rail, which are substantially flat and inclined to one another by an angle substantially greater than 90° and substantially less than 180°.

* * * * *